US005152119A

United States Patent [19]

Miller

[11] Patent Number: 5,152,119

[45] Date of Patent: Oct. 6, 1992

[54] FOLDABLE AND LOCKABLE STRUCTURAL MEMBER FABRICATED FROM RECYCLED PLASTIC

[76] Inventor: Leslie Miller, 159 Foxwood Dr., Jericho, N.Y. 11753

[21] Appl. No.: 636,890

[22] Filed: Jan. 2, 1991

[51] Int. Cl.[5] ..... E04C 3/00

[52] U.S. Cl. ..... 52/731; 52/108; 52/631; 52/732; 27/4

[58] Field of Search ..... 52/108, 631, 731, 732; 27/4

[56] References Cited

U.S. PATENT DOCUMENTS 3,654,053 4/1972 Toedter ..... 52/631
3,969,798 7/1976 Sahlin ..... 27/4

*Primary Examiner*—David A. Scherbel
*Assistant Examiner*—Wynn E. Wood
*Attorney, Agent, or Firm*—Arthur L. Plevy

[57] ABSTRACT

A structural member is an elongated, generally rectangular panel having at least 2 substantially parallel fold lines extending the length of the panel parallel its long sides, preferably defining 3 subpanels. When the panel is folded along the fold lines, preferably by hand, the interior angles at each fold occur on the same surface of the panel, are approximately 90 degrees, and the member has a generally C-shaped cross-section when folded. At least one male/female lock holds each of the panels at a fixed angle relative to the adjacent panel, each male/female lock having a male component affixed to one of the subpanels and a mating female component affixed to the adjacent subpanel such that when said one subpanel is folded with respect to the adjacent subpanel, the male component inserts into the female component and is retained therein.

20 Claims, 3 Drawing Sheets

FOLDABLE AND LOCKABLE STRUCTURAL MEMBER FABRICATED FROM RECYCLED PLASTIC

FIELD OF THE INVENTION

The present invention relates to a structural member, and more particularly to a framing member made from recycled polymeric material as a substantially flat panel, which when folded on the job site, deploys into a member having a C-shaped cross-section.

DESCRIPTION OF THE PRIOR ART

Most buildings employ weight bearing structural members. Large commercial buildings usually have a superstructure for supporting exterior walls, roofs, and floor surfaces and transferring the load of these components to the foundation. The superstructure is frequently constructed of steel beams, but other materials such as concrete, brick and blocks are used. Residential buildings also require weight bearing members and these are normally made of wood, brick, stone or block. In residential structures, wooden weight bearing members are often compound, being composed of a frame having multiple studs and oft times having a plywood or waferboard skin, both to provide a solid surface for exterior walls and to increase strength. Because the weight supported by a framing unit is distributed over numerous studs, each stud bears a modest amount of weight. The studs also function as mounting points for the plywood or waferboard skin, as well as, interior wall material, such as sheetrock or wall board which is nailed to the studs. Framing units are also commonly used to partition buildings into rooms. In buildings having a superstructure, these partitions are typically not weight bearing, thus the wall support must merely be strong enough to keep the wall material, usually sheetrock, in an upright position and to tolerate occasional impacts from the occupants without collapsing. In small buildings, such as houses, the interior walls are also sometimes merely partitions. In instances where the interior walls do support the overall structure, each of the multiple studs is required to bear only a modest compressive load. There is a need, therefore for a structural member which can be used freely in forming framing units which can bear moderate compressive forces and an occasional shearing stress exerted by a building occupant. This need is presently routinely met by the wooden stud, for example, the Two by Four. The wooden stud, while serving its purpose for many years, is derived from the deforestation of the earth and is growing increasingly expensive due to labor, machine and energy costs, as well as, to shrinking availability.

It is a common objective today that materials be put to efficient use, both for the purposes of economy and for ecological reasons. The tendency then is to let design strength compensate for material strength. An example of structural member design which is economical of material while preserving rigidity is the typical I-beam, angle iron or C-shape channel beam. Of course, these building members have been utilized for many years, but new variations do occasionally arise. A recent example of such a variation in the use of C-shaped steel channel members for building structures appears in U.S. Pat. No. 4,697,393 entitled METAL BUILDING CONSTRUCTION, issued Oct. 6, 1987 to Madray. The Madray patent teaches use of C-shape channel for framing buildings, using the channel as wall studs, roofing joists, and ceiling headers etc. Madray suggests, however, that the interior partitioning of the structure be accomplished by conventional methods, such as, wooden framing and sheetrock. In order to be sufficiently rigid for the purpose of framing a building, the metal C-shaped channel employed in Madray is made from steel or aluminum, and is pre-formed in a suitable fabricating facility using heavy duty bending equipment.

Light-duty, material efficient, metal studding systems for framing interior wall partitions have also been designed. For example, U.S. Pat. No. 2,218,426 entitled METAL STUDDING SYSTEM, issued Oct. 15, 1940 to W. G. Hurlbert Jr., illustrates a telescoping metal stud which is received and retained between upper and lower metal tracks. A slot in the top and bottom tracks receives retainer tabs and a retainer flange, respectively, protruding from the top and bottom of the stud. The stud is placed between the top and bottom tracks and twisted so that the tabs and flange lock into the respective slots.

Generally, structural members are made of metal, brick, block, cement or wood. Each of these materials exhibit mechanical strength and rigidity but they are also heavy, expensive, and often occupy a significant amount of space. Building materials of this type are typically preformed by an industrial process and can not be shipped in a compact form and later deployed for use. U.S. Pat. No. 3,300,940 entitled ELONGATED HOUSING issued Jan. 31, 1967 to Golasz, however, shows a folding decorative covering constructed from light weight material, such as, cardboard. The covering may be embossed or bear other surface treatment to simulate woodgrain, for example. The Golasz device is essentially a simulated beam that may be constructed around an unsightly steel I-beam or the like. The Golasz patent shows that the covering may be manufactured as a flat member and later folded or bent to form the desired cosmetic shape. The covering is held in place by internally mounted rubber bands or the like which urge the free edges of the covering inwardly where they are received in brackets screwed to a support surface, such as a ceiling, and adapted to receive the edges.

Structural building materials, unlike the cosmetic covering shown in Golasz, are typically recovered from the earth and require extensive processing at great expense in terms of human labor, energy consumption and environmental impact. The harvesting and processing of wood and the mining and processing of iron, for example, are clearly costly in the aforementioned ways. In contrast to these materials, which are scarce and environmentally and economically costly to acquire, there is a great oversupply of plastic waste products. Plastic wastes, such as, discarded bottles and containers, are difficult and expensive to dispose of due to their resistance to natural decomposition, and therefore tend to swell landfills. Unlike glass bottles and jars, plastic food containers can not be recycled simply by sterilization and reuse. Rather, plastic waste items must typically be chopped into small pieces and remelted, the melt being used to form any of a number of end-products. If the end-product produced is a food container, for example, it must be formed from waste items which are carefully sterilized and sorted prior to recycling. These processes insure the elimination of bacteria and other infectious agents from the end-product of recycling, as well as, providing a container which has a clean appearance. In producing translucent white milk bottles, for example, all colored plastic bottles must be sorted out and removed from the mix. The recycling of plastic waste would be greatly simplified if the waste items did not require sterilization and sorting prior to melting and formulation of the end-product. Since structural building materials need not be sterile, nor is there a need for purity in formulation or homogeneous color composition, it is an object of the present invention to provide a recycled end-product for substantially unsorted plastic waste.

It is a further object of the present invention to provide an inexpensive, lightweight support member that stores flat and can be quickly and easily deployed into a C-shaped support beam to be used, for example, as studding in a wall framing unit and/or to support, for example, a sheetrock partition.

It is yet a further object to provide the aforegoing folding support member from a readily accessible inexpensive material which can be acquired in an environmentally conscientious manner.

SUMMARY OF THE INVENTION

The problems and disadvantages associated with the conventional techniques and devices of making and using structural members are overcome by the present invention which includes a structural member which is an elongated, generally rectangular panel with at least 2 substantially parallel fold lines extending the length of the panel parallel to its long sides and defining at least 3 subpanels. When the member is folded along the fold lines, the interior angles at each fold occur on the same surface of the panel. A locking device is provided on the panel for holding it in a folded condition by independently locking each subpanel to the adjacent subpanel.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
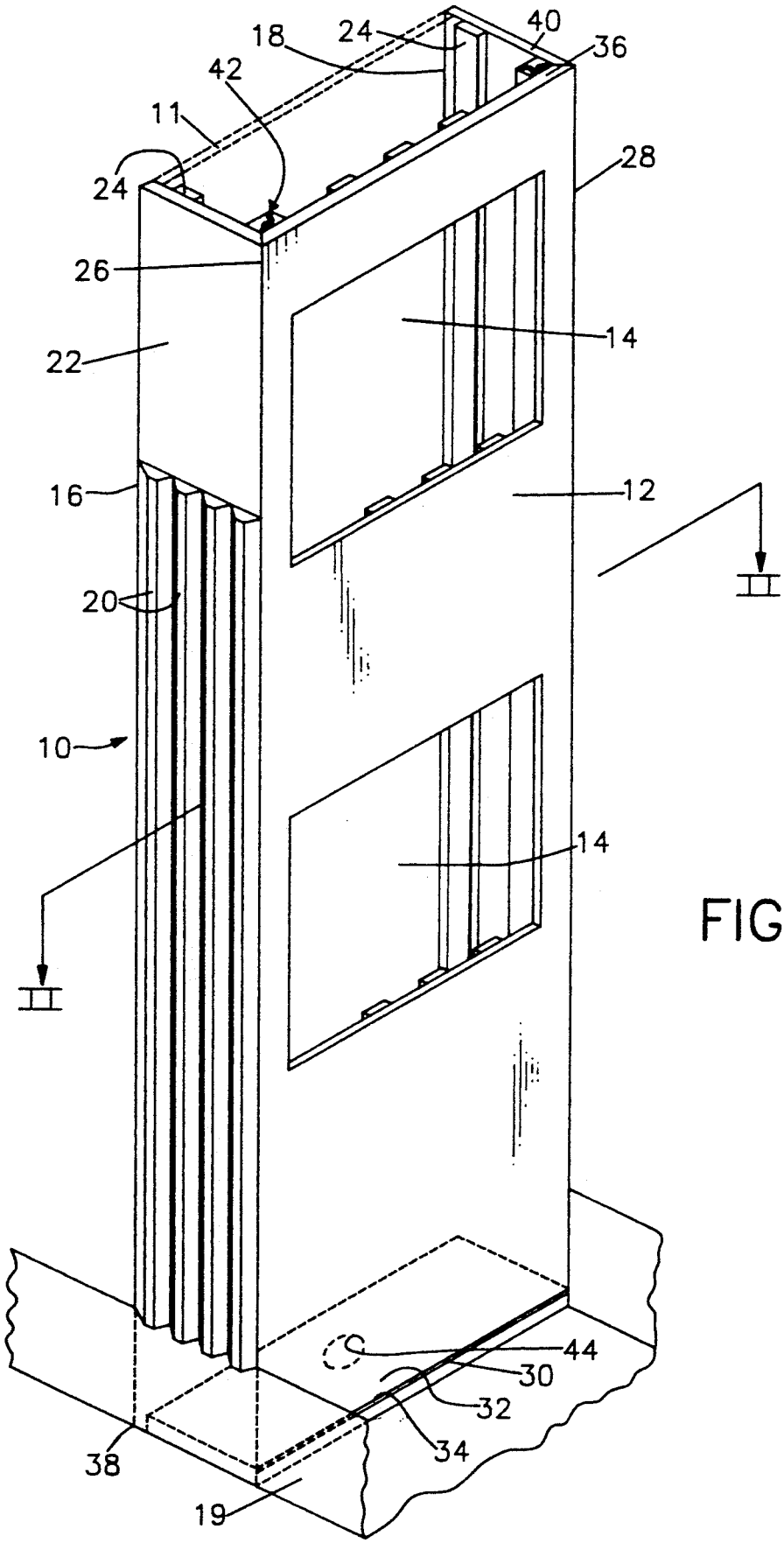
FIG. 1 is a perspective view of a folding support member in accordance with an exemplary embodiment of the present invention.

FIG. 1 shows a framing member 10 in accordance with an exemplary embodiment of the present invention. The member 10 is preferably in the form of a three sided channel having a C-shaped cross-section. A four sided member 10 could be employed, however, as suggested by wall 11 shown in dotted lines. The middle panel 12 of the member 10 has a selected number of apertures 14 to permit electrical conduit, plumbing lines, and the like, to be passed through the member 10 without cutting holes therein. Any number of apertures 14 can be provided according to the use to which the member is put. The side panels 16 and 18 may be strengthened by strength ribs 20 to prevent bending of the panels in response to shearing stress. Flats 22 may be formed at selected positions along the member 10 to permit the insertion of the member into a suitably proportioned space. FIG. 1 shows the member 10 inserted into a floor channel 19. A similar channel could be provided for securing the top of the member 10 to the ceiling. The flats 22 may be positioned at any point along the length of the member 10 in order to achieve greater clearance than would be available if the strength ribs 20 were present at that position. The strength ribs 20 cause the surface of the member to protrude beyond the plane occupied by the sidewall of the channel 19. This is beneficial if, for example, the end of the member 10 is secured to the channel 19 by nails or screws which protrude above the surface of the channel 19. The member 10 may also be strengthened by internal ribs 24 disposed towards the interior surface of the "C"-shape. It should be noted that the strength ribs 20 and/or the internal ribs 24 can have a cross-sectional shape other than rectangular or trapezoidal as shown, e.g., they could have a triangular or semicircular profile. The end panels 16 and 18 are attached along one edge thereof to the middle panel 12 by a hinge joint 26 and 28, respectively, and preferably by a flexible thinning of material commonly called a "living hinge". A similar hinge joint 30 may be provided to secure a tack panel 32 to the bottom edge 34 and/or the top edge 36 of the middle panel 12 or to the bottom edge 38 and/or top edge 40 of either or both side panels 16 and 18. Viewing the top portion of the member 10 proximate the hinge joints 26 and 28, the top portion of a corner lock 42 is visible. The corner lock 42 secures the side panels 16 and 18 relative to the middle panel 12 to maintain the C-shape of member 10 as shall be further described below. The optional tack panel 32 may be nailed or screwed to a floor or ceiling joist to secure the member 10 thereto. Alternatively, the member 10 may be held in position relative a joist via slotted tracks as shown in FIG. 1. The tracks are then secured to the floor and ceiling by nails or other conventional means. Another alternative would be to toe nail the members 10 to joists through the ends of the side panels 16 and 18 and/or middle panel 12. The member 10 may be provided with pilot holes 44, like that shown in the tack panel 32, through which a nail shaft would pass but not the nail head, in order to simplify the assembly process of the members 10 into a framework and to lessen the possibility that a nail or screw will crack a member 10. The member 10 is preferably constructed from polystyrene, polyurethane or any other resilient and available polymeric compound. The preferred source of this polymeric material is recycled plastic milk, orange juice and soda bottles, antifreeze, bleach and oil jugs, etc. Refuse of this nature is plentiful and constitutes a source of environmental pollution. The ubiquitous framing stud is an appropriately large repository for such ubiquitous pollutant items.

Figure 2:
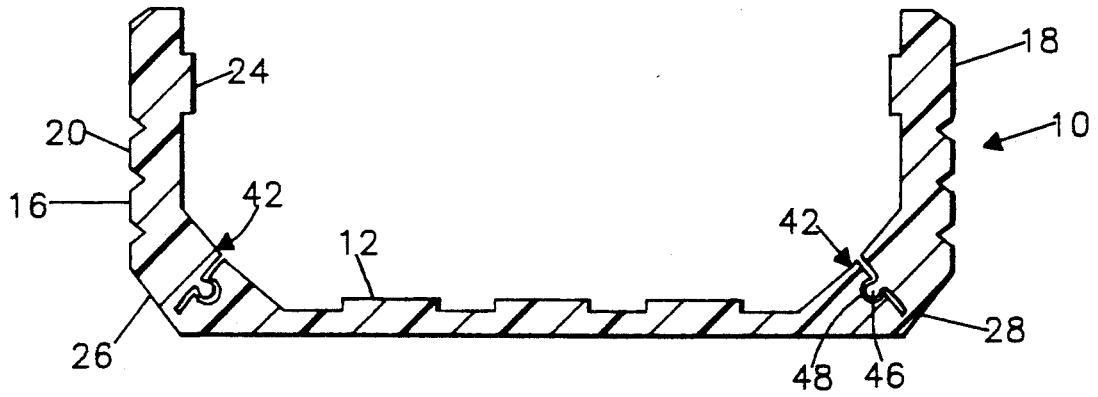
FIG. 2 is a cross-sectional view of the member of FIG. 1 taken along section line II—II and looking in the direction of the arrows.
Figure 3:
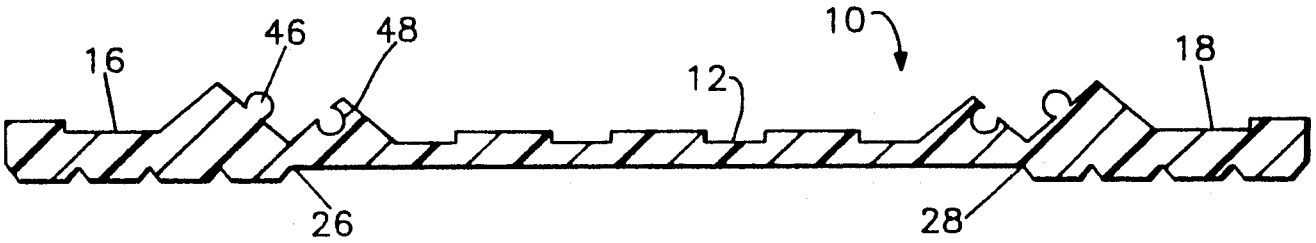
FIG. 3 is the same cross-sectional view of the member as shown in FIG. 2 but with the member in the unfolded position.
Figure 4:
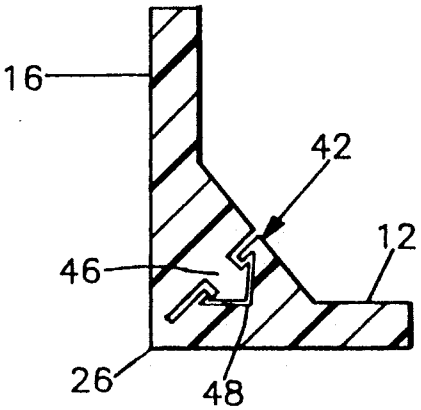
FIG. 4 is a partial, segmented, cross-sectional view of an alternate embodiment of the corner locking means of the member depicted in FIG. 2.

FIGS. 2 and 3 show the member 10 in cross-section. In FIG. 2 the side panels 16 and 18 are locked at approximately right angles to the middle panel 12 by the corner locks 42. The corner locks 42 are essentially mating male and female friction/snap fittings. In the embodiment shown in FIG. 2, the male portion is in the form of a ball or sphere 46 protruding from the interior of the side panels 16 and 18 proximate the hinge joints 26 and 28. The male portion is received within a mating socket 48 formed in the middle panel proximate the hinge joints 26 and 28. While a plurality of spaced male and female fittings may be disposed along the length of the joints 26 and 28, an alternative is to configure the male portion as an elongated beading and the female portion as an elongated groove. FIG. 4 depicts an alternative shape for the male and female portions which could once again be expressed as either a continuous beading and mating groove having this cross-sectional shape or a plurality of discrete buttons and receiver sockets.

It should be understood that the embodiments described herein are merely exemplary and that a person skilled in the art may make many variations and modifications without departing from the spirit and scope of the invention as defined in the appended claims.

I claim:

1. A structural member comprising:

(a) an elongated, generally rectangular panel having at least 2 substantially parallel fold lines extending the length of said panel parallel to the long sides of said panel, whereby at least 3 subpanels are formed when said panel is folded along said fold lines, the interior angles at each fold occurring on the same surface of said panel; and (b) internal locking means affixed to said panel along each of said fold lines for holding said panel in a folded condition by independently and automatically locking each said subpanel at a fixed angular position relative to an adjacent said subpanel, as said subpanel is folded along said fold lines into said angular position, said locking means being the sole means for holding said panel in said folded condition and further, preventing each said subpanel from being nondestructively unfolded from said angular position.

2. The structural member of claim 1, wherein said fold lines are 2 in number, said subpanels are 3 in number, said interior angles are approximately 90 degrees, and said member has a generally C-shaped cross-section when folded.

3. The structural member of claim 2, wherein said locking means is located on said same surface as said interior angles and said panel is foldable by hand.

4. The structural member of claim 3, wherein said locking means includes at least one male/female lock to hold each of said subpanels at said fixed angular position, each male/female lock having a male component affixed to one of said subpanels and a mating female component affixed to said adjacent said subpanel such that when said one subpanel is folded with respect to said adjacent subpanel, said male component locks into said female component.

5. The structural member of claim 4, wherein said panel and said lock means are monolithically formed from a polymer.

6. The structural member of claim 5, wherein said male component is a beading and said female component is a groove configured to retain said male component after insertion.

7. The structural member of claim 6, wherein said panel is thinned along said fold line to promote the folding of said panel along said fold line.

8. The structural member of claim 7, wherein at least one of said subpanels has stiffening means on at least one surface thereof for stiffening said subpanel.

9. The structural member of claim 8, wherein said stiffening means includes a plurality of substantially elongated ribs projecting from said at least one surface and running in the direction of said fold lines on said panel.

10. The structural member of claim 9, wherein at least one of said subpanels has apertures therein for utility lines to pass through.

11. The structural member of claim 5, wherein said polymer is formed of recycled polymeric material.

12. The apparatus of claim 4, wherein said panel has a tacking member foldable perpendicular to the length of said panel extending from at least one end thereof to permit said panel to be fixed to a surface by a fastener passing through said tacking member.

13. The structural member of claim 4, wherein said member when folded is proportioned to fit within a framing channel.

14. The structural member of claim 6, wherein said beading has in cross-section a spherical portion and said groove has in cross-section a spherical socket complete beyond a hemisphere, the portion of said socket in excess of a hemisphere partially surrounding and retaining said male component after insertion.

15. The structural member of claim 5, wherein said locking means includes a plurality of mating ball and socket sets disposed proximate said fold lines.

16. The structural member of claim 1, wherein said fold lines are 3 in number, said subpanels are 4 in number, said interior angles are approximately 90 degrees, and said member has a generally box-shaped cross-section when folded.

17. The structural member of claim 5, wherein said member is formed by extrusion.

18. A structural member comprising:

(a) an elongated, generally rectangular panel having at least 2 substantially parallel fold lines extending the length of said panel parallel to the long sides of said panel, whereby at least 3 subpanels are formed when said panel is folded along said fold lines, the interior angles at each fold occurring on the same surface of said panel;

(b) internal locking means affixed to said panel along each of said fold lines for holding said panel in a folded condition by independently and automatically locking each said subpanel at a fixed angular position relative to an adjacent said subpanel, as said subpanel is folded along said fold line into said angular position, said locking means preventing each said subpanel from being nondestructively unfolded from said angular position; and (c) at least one aperture formed through at least one of said subpanels for the passage of utility lines therethrough.

19. The structural member of claim 18, wherein at least one of said subpanels has a plurality of substantially parallel elongated ribs projecting from said at least one surface and running in the direction of said fold lines on said panel.

20. The structural member of claim 18, wherein aid locking means includes at least one male/female lock to hold each of said subpanels at said fixed angular position, each male/female lock having a male component affixed to one of said subpanels and a mating female component affixed to said adjacent said subpanel such that when said one subpanel is folded with respect to said adjacent subpanel, said male component locks into said female component.

* * * * *